US009744401B2

(12) United States Patent
Lalaoua

(10) Patent No.: US 9,744,401 B2
(45) Date of Patent: Aug. 29, 2017

(54) MULTIFUNCTIONAL EXERCISE MACHINE

(71) Applicant: Nabile Lalaoua, Las Vegas, NV (US)

(72) Inventor: Nabile Lalaoua, Las Vegas, NV (US)

( * ) Notice: Subject to any disclaimer, the term of this patent is extended or adjusted under 35 U.S.C. 154(b) by 0 days.

(21) Appl. No.: 15/204,863

(22) Filed: Jul. 7, 2016

(65) Prior Publication Data

US 2017/0014674 A1 Jan. 19, 2017

Related U.S. Application Data

(63) Continuation-in-part of application No. 15/187,564, filed on Jun. 20, 2016.

(60) Provisional application No. 62/231,629, filed on Jul. 13, 2015.

(51) Int. Cl.

| | |
|---|---|
| ***A63B 21/00*** | (2006.01) |
| ***A63B 22/06*** | (2006.01) |
| ***A63B 21/015*** | (2006.01) |
| ***A63B 22/00*** | (2006.01) |
| ***A63B 22/20*** | (2006.01) |
| *A63B 69/00* | (2006.01) |
| *A63B 21/008* | (2006.01) |
| *A63B 21/22* | (2006.01) |
| *A63B 71/00* | (2006.01) |

(52) U.S. Cl.

CPC ..... *A63B 22/0605* (2013.01); *A63B 21/015* (2013.01); *A63B 21/154* (2013.01); *A63B 22/0046* (2013.01); *A63B 22/201* (2013.01); *A63B 21/00069* (2013.01); *A63B 21/0083* (2013.01); *A63B 21/225* (2013.01); *A63B 21/4035* (2015.10); *A63B 69/0057* (2013.01); *A63B 2022/206* (2013.01); *A63B 2071/009* (2013.01); *A63B 2208/0204* (2013.01); *A63B 2208/0233* (2013.01); *A63B 2210/50* (2013.01); *A63B 2220/17* (2013.01); *A63B 2225/09* (2013.01); *A63B 2225/10* (2013.01); *A63B 2230/75* (2013.01)

(58) Field of Classification Search

USPC ..... 482/51–65

See application file for complete search history.

(56) References Cited

U.S. PATENT DOCUMENTS 5,299,995 A * 4/1994 Ko ..... A63B 23/0417 482/52
6,468,184 B1 * 10/2002 Lee ..... A63B 22/0664 482/51
6,905,442 B1 * 6/2005 Lee ..... A63B 22/001 482/51

(Continued)

*Primary Examiner* — Stephen R Crow

(57) ABSTRACT

A multifunctional exercise machine is an exercise machine that combines a stepper assembly and a stationary bicycle assembly into a single machine. The stepper assembly is positioned on a frame member while the stationary bicycle assembly is positioned on a stand member. The frame member and the stand member are both hingedly connected to a bridge positioned in between the frame member and the stand member. A stepper resetting mechanism is utilized to regulate the movement of a first step pedal and a second step pedal of the stepper assembly. The first step pedal and the second step pedal are slidably engaged to a first rail and a second rail of the frame member. The machine may be utilized in a standing position or in a seated position via an adjustable seat. A handlebar assembly may be utilized for user stability while exercising.

11 Claims, 7 Drawing Sheets

(56) References Cited

U.S. PATENT DOCUMENTS

| | | | | |
|---|---|---|---|---|
| 7,637,848 | B1 * | 12/2009 | Chang | A63B 22/001 482/51 |
| 8,033,961 | B2 * | 10/2011 | Kuo | A63B 21/154 482/51 |
| 2009/0239714 | A1 * | 9/2009 | Sellers | A63B 22/001 482/52 |
| 2012/0277066 | A1 * | 11/2012 | Hsu | A63B 22/001 482/57 |
| 2015/0141200 | A1 * | 5/2015 | Murray | A63B 21/154 482/5 |
| 2015/0165255 | A1 * | 6/2015 | Chen | A63B 21/00189 482/130 |
| 2015/0375030 | A1 * | 12/2015 | Yang | A63B 21/015 482/52 |
| 2016/0361588 | A1 * | 12/2016 | Kuo | A63B 22/0015 |
| 2017/0014674 | A1 * | 1/2017 | Lalaoua | A63B 22/0605 |
| 2017/0028249 | A1 * | 2/2017 | Huang | A63B 22/0664 |
| 2017/0028250 | A1 * | 2/2017 | Huang | A63B 22/0664 |
| 2017/0043207 | A1 * | 2/2017 | Zeng | A63B 22/0012 |

* cited by examiner

MULTIFUNCTIONAL EXERCISE MACHINE

The current application claims a priority to the U.S. Provisional Patent application Ser. No. 62/231,629 filed on Jul. 13, 2015.

FIELD OF THE INVENTION

The present invention relates generally to an exercise machine. More specifically, the present invention is a multifunctional exercise machine that combines the functionality of a stepping machine and a stationary bicycle.

BACKGROUND OF THE INVENTION

Stepping machines and stationary bicycles are often favored for exercise due to their safety and effectiveness in improving cardiovascular endurance as well as lower body muscle strength. Stepping machines and stationary bicycles are effective for low impact exercise due to the fact that the feet remain in contact with the steps and the pedals respectively when performing exercise. This results in less stress on the joints, muscles, and tendons. Additionally, the user's movement during exercise on a stepping machine or a stationary bicycle is fluid and continuous rather than sporadic. Stepping machines and stationary bicycles are often utilized for physical therapy and rehabilitation due to the low impact exercise provided. Stepping machines and stationary bicycles typically include a mechanism for adjusting the intensity of a workout by increasing or decreasing the resistance experienced by the user when stepping or cycling.

The present invention is a multifunctional exercise machine that combines the functionality of a stepping machine and a stationary bicycle. As such, the present invention provides the user with multiple low impact exercise options for improving cardiovascular endurance and lower body muscle strength.

DETAIL DESCRIPTIONS OF THE INVENTION

Figure 1:
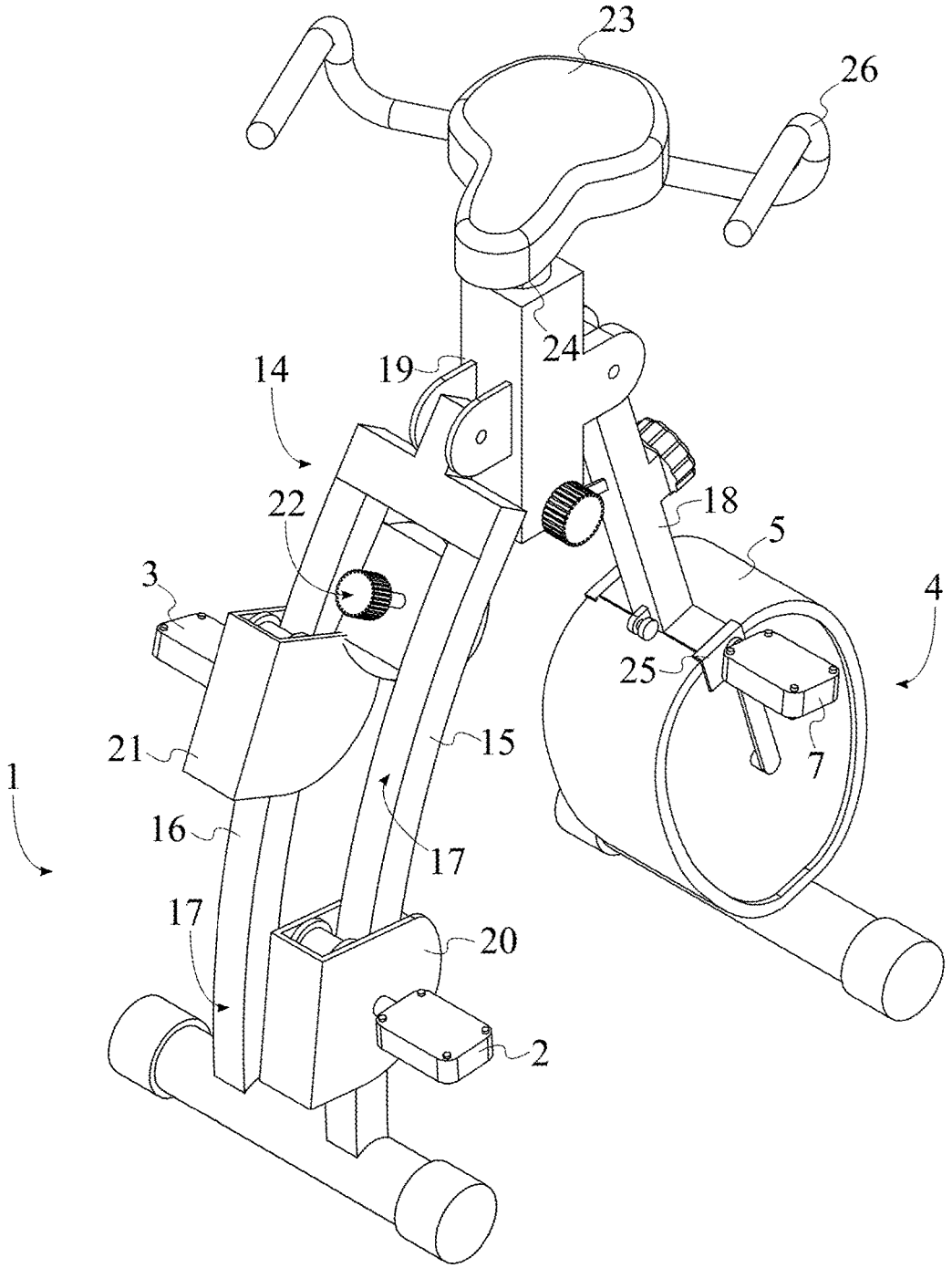
FIG. 1 is a front perspective view of the present invention.
Figure 2:
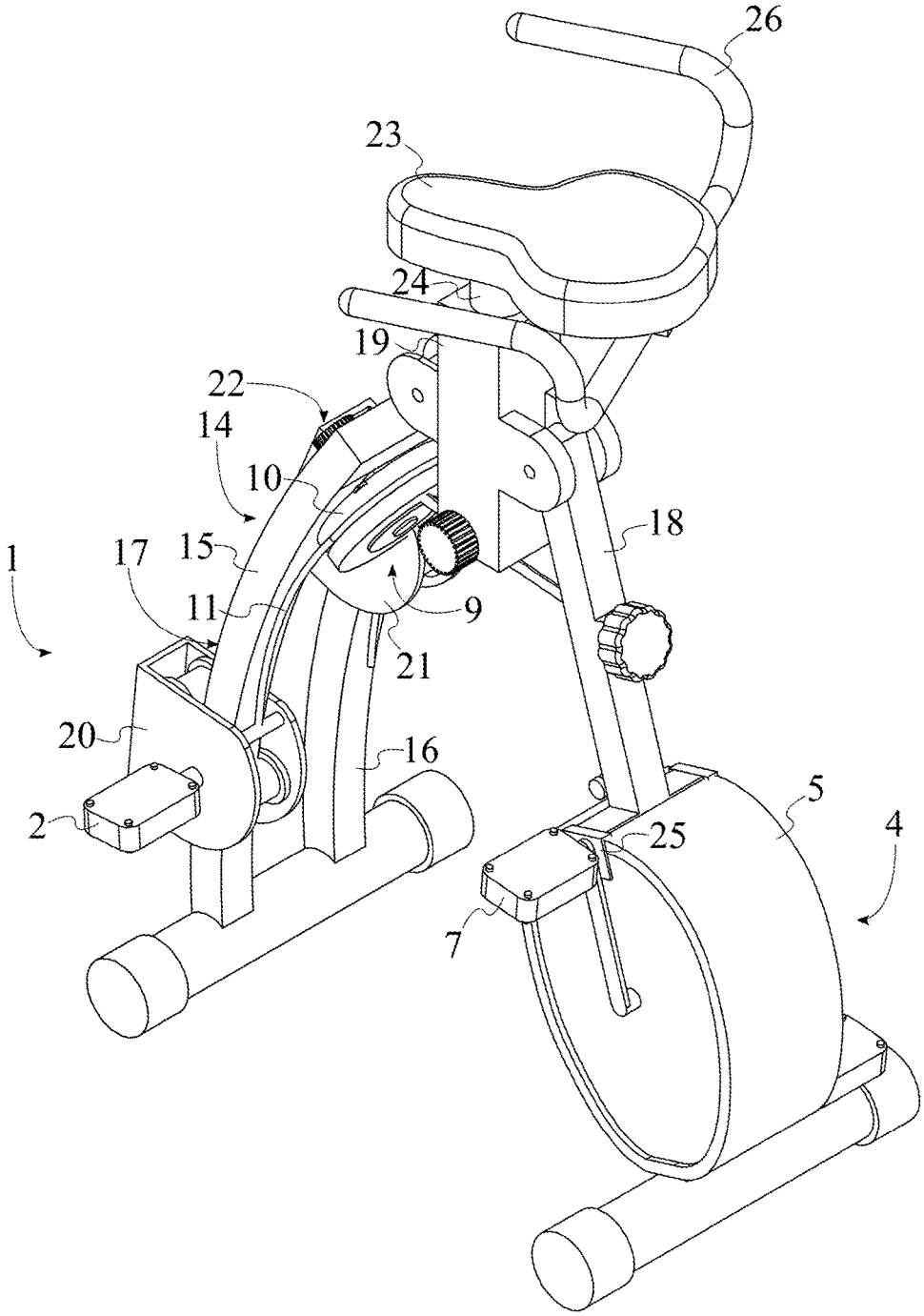
FIG. 2 is a rear perspective view of the present invention.

All illustrations of the drawings are for the purpose of describing selected versions of the present invention and are not intended to limit the scope of the present invention.

The present invention is a multifunctional exercise machine that provides the user with the functionality of both a stepping machine and a stationary bicycle. The present invention is shown in FIGS. 1-4 and comprises a stepper assembly 1, a stationary bicycle assembly 4, a stepper resetting mechanism 9, a frame member 14, a stand member 18, and a bridge 19.

The stepper assembly 1 functions similarly to a stepping machine that is utilized to improve cardiovascular endurance as well as lower body muscle strength. The stepper assembly 1 comprises a first step pedal 2 and a second step pedal 3. The user's feet are placed into contact with the first step pedal 2 and the second step pedal 3 during use of the stepper assembly 1. For user safety, the first step pedal 2 and the second step pedal 3 may be covered with a rubberized coating in order to minimize slippage. The frame member 14 serves as a base for the stepper assembly 1. The first step pedal 2 and the second step pedal 3 are slidably mounted along the frame member 14, allowing the first step pedal 2 and the second step pedal 3 to slide along the frame member 14 when the user applies force with his or her feet. Additionally, the first step pedal 2 and the second step pedal 3 are positioned opposite to each other about the frame member 14. The first step pedal 2 and the second step pedal 3 are thus separated by a sufficient distance such that the user may comfortably exercise utilizing the stepper assembly 1. The stepper resetting mechanism 9 enables the first step pedal 2 and the second step pedal 3 to slide relative to each other along the frame member 14. The stepper resetting mechanism 9 is operatively connected in between the stepper assembly 1 and the frame member 14, securing the stepper resetting mechanism 9 to the frame member 14 and allowing the stepper resetting mechanism 9 to regulate the movement of the first step pedal 2 and the second step pedal 3. In the preferred embodiment of the present invention, the stepper resetting mechanism 9 returns the first step pedal 2 and the second step pedal 3 from an actuated position to an equilibrium position. This enables the first step pedal 2 and the second step pedal 3 to slide in opposite directions relative to each other along the frame member 14.

The stand member 18 serves as a base for the stationary bicycle assembly 4. The bridge 19 serves as a connecting point in between the frame member 14 and the stand member 18. The frame member 14 is hingedly and adjacently connected to the bridge 19. The stand member 18 is hingedly and adjacently connected to the bridge 19 as well, opposite to the frame member 14. This enables the present invention to be folded into a compact configuration for convenient storage.

The stationary bicycle assembly 4 functions similarly to a bicycle and simulates the action of riding a bicycle while remaining in a stationary position. The stationary bicycle assembly 4 is mounted along the stand member 18 and is thus positioned away from the stepper assembly 1.

Figure 3:
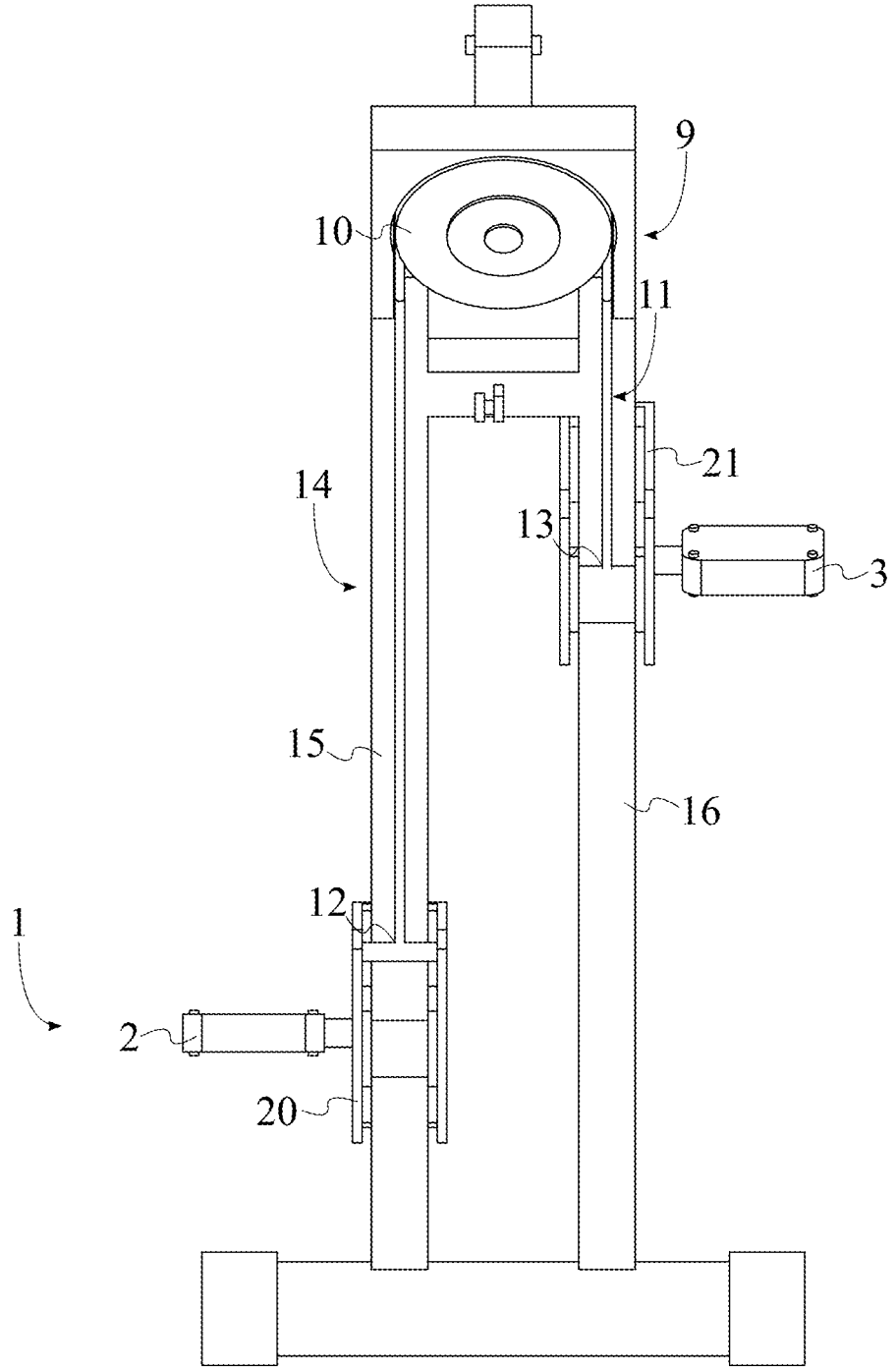
FIG. 3 is a rear view of the stepper assembly, the frame member, and corresponding components.

With continued reference to FIGS. 1-4, the frame member 14 comprises a first rail 15 and a second rail 16. The first rail 15 and the second rail 16 enable the first step pedal 2 and the second step pedal 3 to slide along the frame member 14. The first rail 15 and the second rail 16 are positioned adjacent to each other in order to enable the first step pedal 2 and the second step pedal 3 to move side-by-side. The first step pedal 2 is slidably engaged to the first rail 15 while the second step pedal 3 is slidably engaged to the second rail 16. The first step pedal 2 and the second step pedal 3 are thus able to slide along the first rail 15 and the second rail 16, respectively, under influence of the stepper resetting mechanism 9. In the preferred embodiment of the present invention, the stepper resetting mechanism 9 comprises a pulley 10 and a chain 11 that are utilized to move the first step pedal 2 and the second step pedal 3 in opposite directions relative to each other along the frame member 14 during use of the stepper assembly 1. As shown in FIG. 3, a first end 12 of the chain 11 is tethered to the first step pedal 2 while a second end 13 of the chain 11 is tethered to the second step pedal 3. The chain 11 is thus able to pull and direct the movement of the first step pedal 2 and the second step pedal 3 along the first rail 15 and the second rail 16. The pulley 10 is rotatably mounted to the first rail 15 and the second rail 16 while the chain 11 is tensionably engaged about the pulley 10. As a result, the sliding motion of the first step pedal 2 and the second step pedal 3 on the first rail 15 and the second rail 16 allows the chain 11 to rotate the pulley 10, ensuring that the first step pedal 2 and the second step pedal 3 slide in opposite directions relative to each other on the first rail 15 and the second rail 16. The pulley 10 is positioned adjacent to the bridge 19 and is thus offset from the stepper assembly 1 on the frame member 14.

Alternative embodiments of the present invention may utilize various additional types of mechanisms for the stepper resetting mechanism 9. One such example is a hydraulic cylinder mechanism featuring two hydraulic cylinders that serve to return the first step pedal 2 and the second step pedal 3 from an actuated position to an equilibrium position when the hydraulic cylinders are actuated. The hydraulic cylinders may be connected to the frame member 14 in a manner such that the present invention may still be folded into a compact configuration.

With continued reference to FIGS. 1-4, in various embodiments of the present invention, the first step pedal 2 and the second step pedal 3 may be removable from the first rail 15 and the second rail 16. As such, the present invention further comprises a first detachable carriage 20 and a second detachable carriage 21 that enable the first step pedal 2 and the second step pedal 3 to be removed from the frame member 14 as needed. The user may wish to remove the first step pedal 2 and the second step pedal 3 in order to ensure that the first step pedal 2 and the second step pedal 3 do not obstruct the user's legs during use of the stationary bicycle assembly 4. The first step pedal 2 is slidably mounted to the first rail 15 by the first detachable carriage 20 while the second step pedal 3 is slidably mounted to the second rail 16 by the second detachable carriage 21. The first detachable carriage 20 and the second detachable carriage 21 are thus able to slide along the first rail 15 and the second rail 16 along when the user applies force to the first step pedal 2 and the second step pedal 3.

In the preferred embodiment of the present invention, the first rail 15 and the second rail 16 are curved and each comprise a concave portion 17. The curved design of the first rail 15 and the second rail 16 provides a beneficial effect to the unique range of motion experienced by the user during use of the stepper assembly 1. The concave portion 17 is oriented toward the frame member 14 in order to provide an alternative range of motion during exercise compared to the range of motion provided by a straight design.

The present invention further comprises a chain braking system 22 that is utilized to adjust the difficulty of exercising utilizing the stepper assembly 1. The chain braking system 22 is mechanically integrated between the frame member 14 and the stepper resetting mechanism 9. As such, the chain braking system 22 is able to adjust the resistance of the stepper resetting mechanism 9 to the movement of the first step pedal 2 and the second step pedal 3 on the first rail 15 and the second rail 16 while the user is exercising. The chain 11 is operatively integrated through the chain braking system 22, allowing the chain braking system 22 to increase or decrease angular speed of the chain 11 about the pulley 10. This in turn increases or decreases the difficulty of exercise utilizing the stepper assembly 1.

Figure 4:
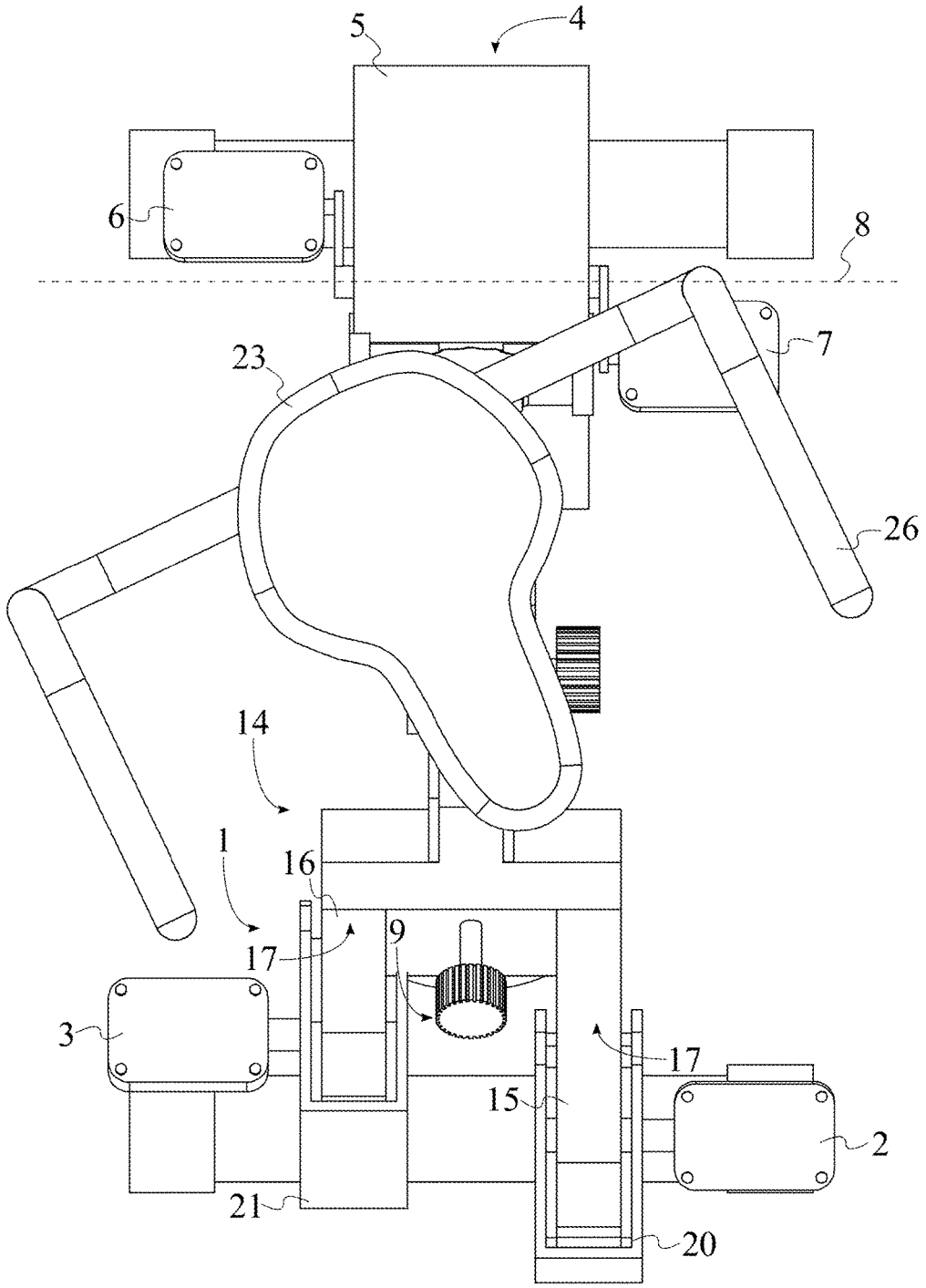
FIG. 4 is a top view of an embodiment of the present invention.

The stationary bicycle assembly 4 comprises a flywheel assembly 5, a first cycle pedal 6, and a second cycle pedal 7. When the user is exercising on the stationary bicycle assembly 4, the first cycle pedal 6 and the second cycle pedal 7 are rotated, causing the flywheel assembly 5 to spin and build momentum. As with the first step pedal 2 and the second step pedal 3, the first cycle pedal 6 and the first cycle pedal 6 may be covered with a rubberized coating to minimize slippage. The flywheel assembly 5 additionally provides constant resistance to the stationary bicycle assembly 4. The resistance of the stationary bicycle assembly 4 may be adjusted in order to increase or decrease the difficulty of exercising utilizing the stationary bicycle assembly 4. The flywheel assembly 5 is mounted along the stand member 18 and is thus positioned away from the stepper assembly 1 positioned on the frame member 14. The first cycle pedal 6 and the second cycle pedal 7 are torsionally connected into the flywheel assembly 5, allowing the first cycle pedal 6 and the second cycle pedal 7 to spin the flywheel assembly 5. As shown in FIG. 4, a rotation axis 8 of the first cycle pedal 6 and a rotation axis 8 of the second cycle pedal 7 are oriented perpendicular to the stand member 18. The stationary bicycle assembly 4 may thus be utilized to exercise in a similar manner to a conventional standalone stationary bicycle.

The present invention may further comprise an adjustable seat 23. The adjustable seat 23 is mounted into the bridge 19 and is thus positioned in between the stepper assembly 1 and the stationary bicycle assembly 4. The adjustable seat 23 may be locked in place via a pin lock. The adjustable seat 23 may be positioned within the bridge 19 in a manner such that the leg room is increased when utilizing the present invention.

Figure 5:
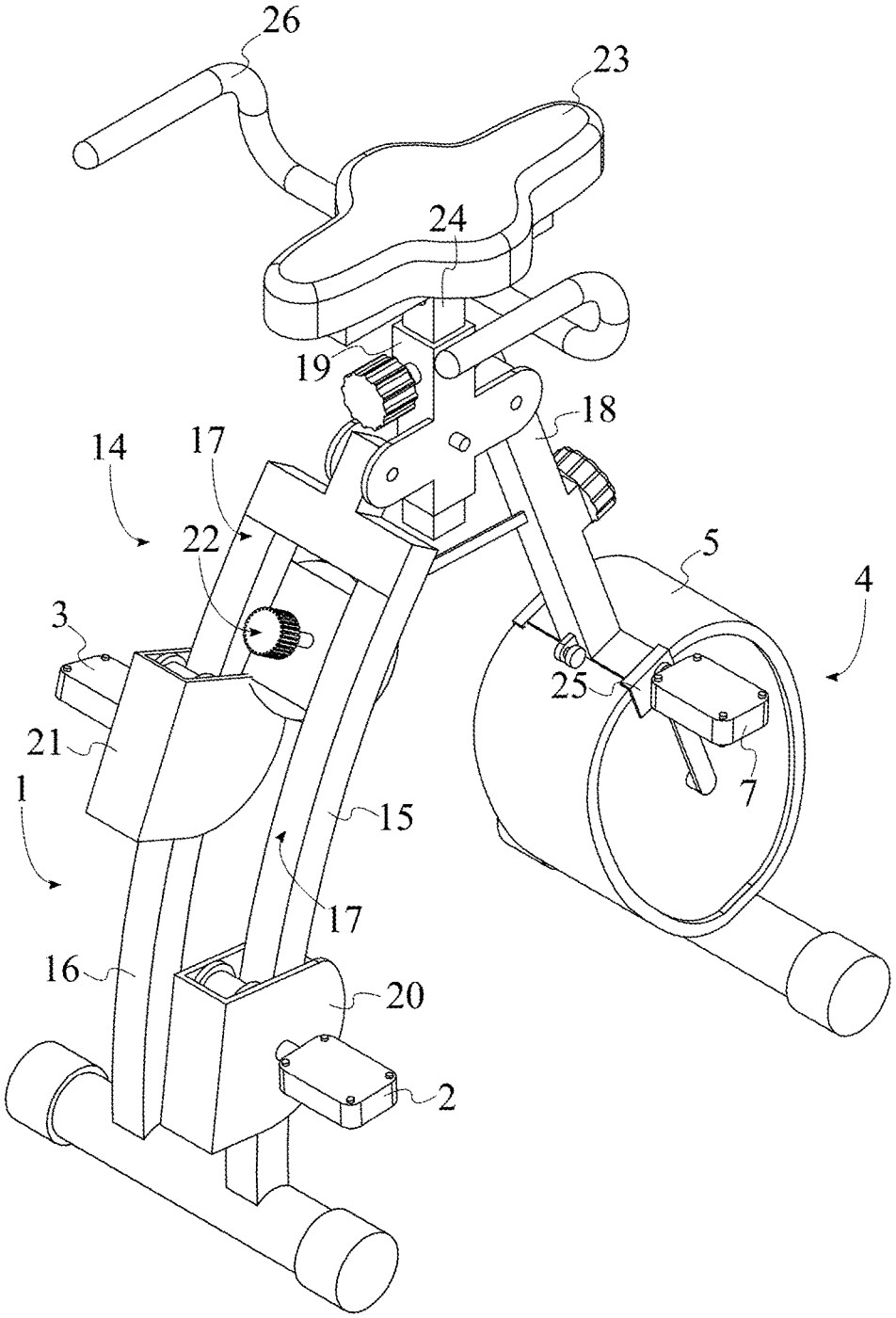
FIG. 5 is a front perspective view of an alternative embodiment of the present invention with a dual-sided adjustable seat.

The present invention may further comprise a seat adjustment member 24. In the embodiment of the present invention shown in FIGS. 1-4, the seat adjustment member 24 is utilized to rotate the adjustable seat 23 to face the stepper assembly 1 or the stationary bicycle assembly 4. In this embodiment of the present invention, the seat adjustment member 24 is rotatably engaged into the bridge 19, enabling the adjustable seat 23 to be rotated to face the stepper assembly 1 or the stationary bicycle assembly 4. The seat adjustment member 24 may then be locked into place. In the embodiment of the present invention shown in FIG. 5, the seat adjustment member 24 is utilized to adjust the height of the adjustable seat 23 relative to the bridge 19. In this embodiment of the present invention, the seat adjustment member 24 is adjacently connected to the adjustable seat 23 and as such may be utilized to increase or decrease the height of the adjustable seat 23. The seat adjustment member 24 is slidably engaged into the bridge 19. The seat adjustment member 24 may thus be inserted into or drawn out of the bridge 19 in order to adjust the height of the adjustable seat 23. After the adjustable seat 23 is at the desired height, the seat adjustment member 24 may be locked into place.

In various embodiments of the present invention, the stationary bicycle assembly 4 may be removable from the stand member 18. The present invention further comprises at least one mounting bracket 25 for use in holding the stationary bicycle assembly 4. The at least one mounting bracket 25 is positioned on the stand member 18, enabling the stationary bicycle to be fastened to the stand member 18 utilizing the at least one mounting bracket 25. The stationary bicycle assembly 4 is removably mounted to the stand member 18 by the at least one mounting bracket 25, allowing the user to remove the stationary bicycle assembly 4 from the stand member 18 altogether. The user may wish to separate the stationary bicycle assembly 4 from the stand member 18 in order to ensure that the stationary bicycle assembly 4 does not obstruct the user's movement during use of the stepper assembly 1.

While the present invention may be utilized hands-free, the present invention may further comprise a handlebar assembly 26 to improve user stability while exercising. The handlebar assembly 26 is mounted into the bridge 19 and may be grasped by the user while exercising to stabilize his or her body.

Figure 6:
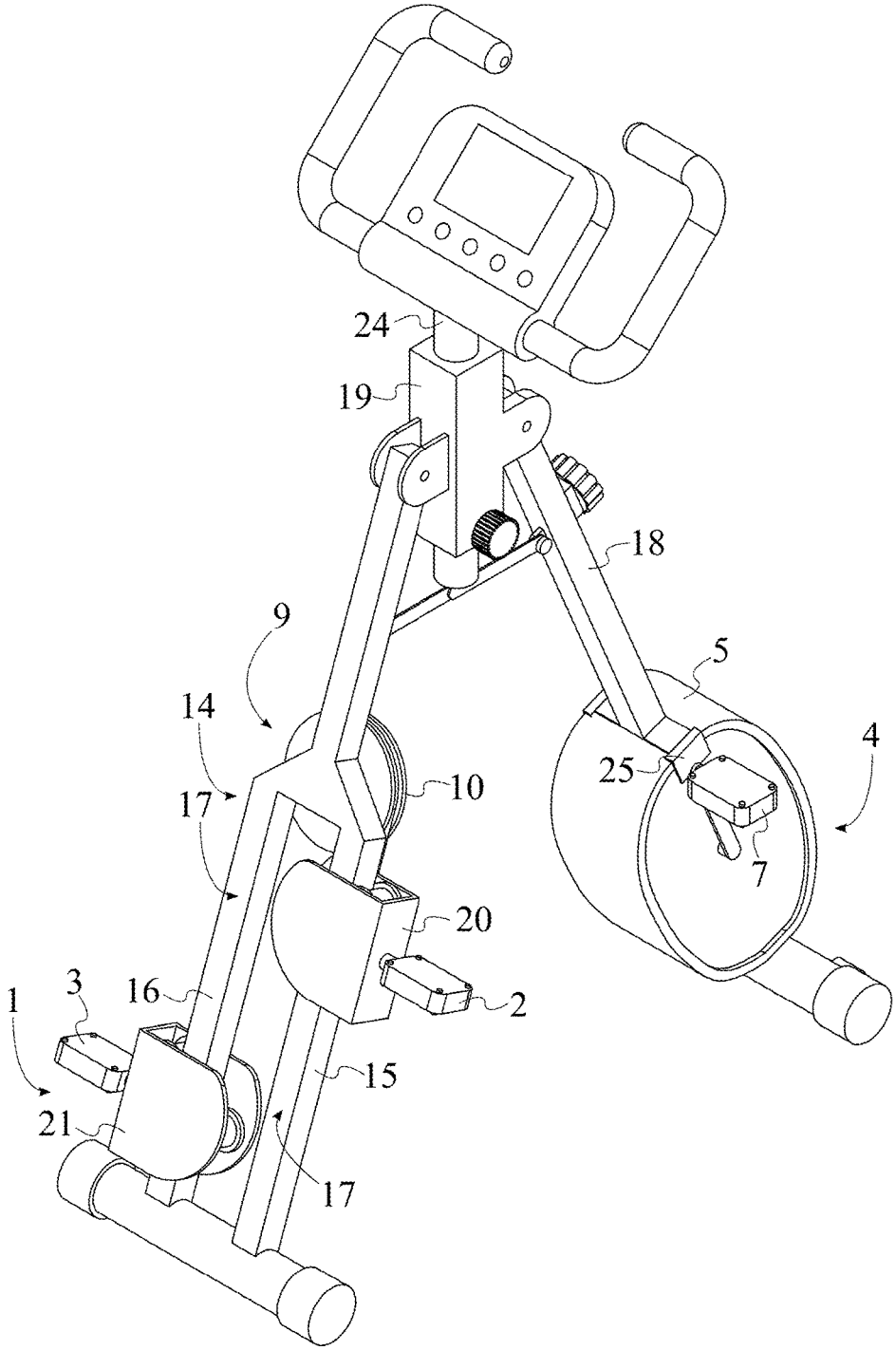
FIG. 6 is a front perspective view of an embodiment of the present invention with an electronic monitoring device.
Figure 7:
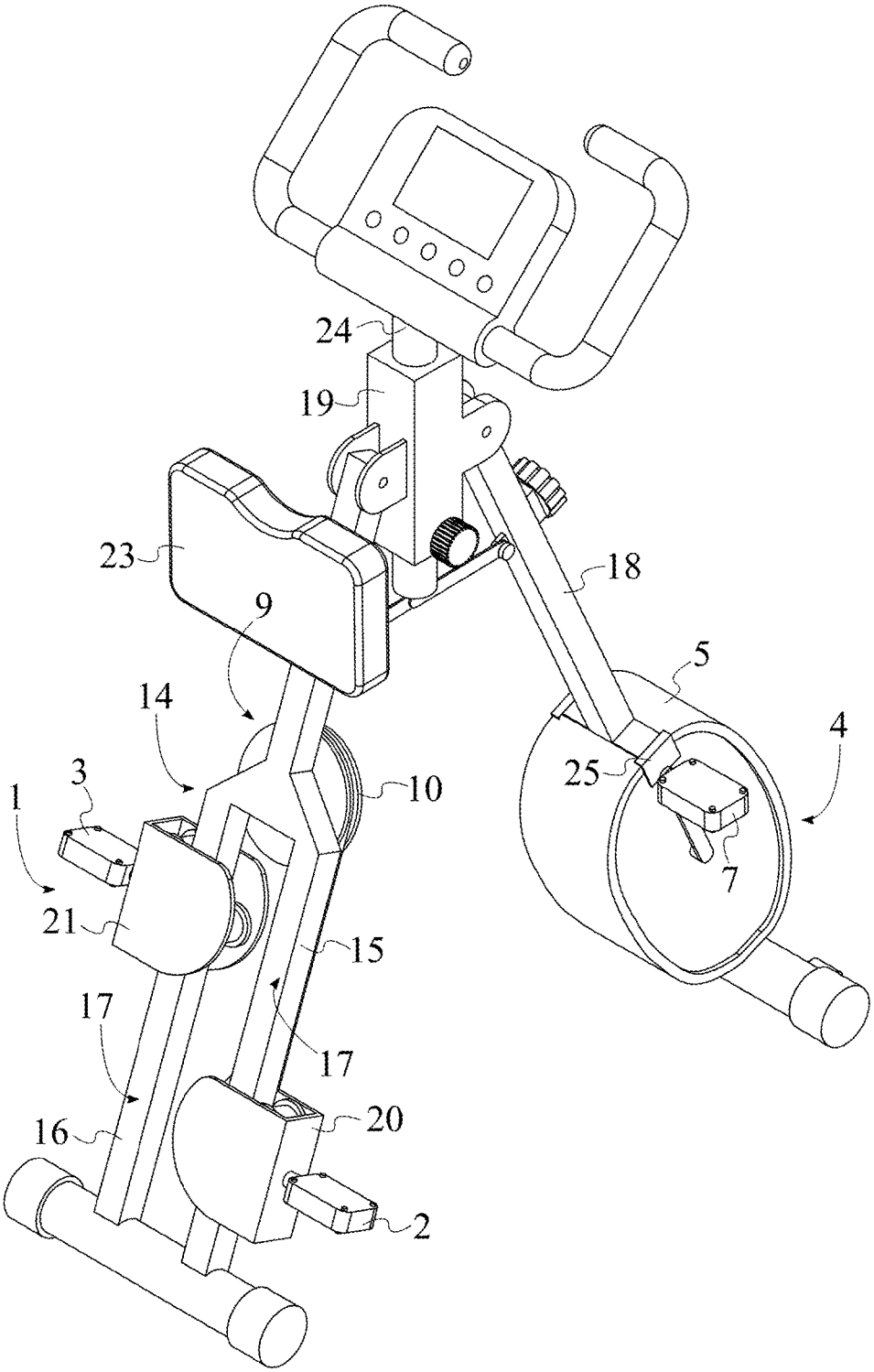
FIG. 7 is a front perspective view of an embodiment of the present invention with an electronic monitoring device and an adjustable seat.

As shown in FIG. 6 and FIG. 7, the present invention may additionally include an electronic monitoring device that is utilized to track various statistics such as total workout time, number of steps taken, and calories burned. The electronic monitoring device may be battery-operated or connected to an external electrical source such as a wall outlet. The electronic monitoring device may be mounted facing toward the stepper assembly 1 or facing toward the stationary bicycle assembly 4. Additionally, the electronic monitoring device may be mounted in a manner such that the orientation of the electronic monitoring device may be changed.

Although the present invention has been explained in relation to its preferred embodiment, it is understood that many other possible modifications and variations can be made without departing from the spirit and scope of the present invention as hereinafter claimed.

What is claimed is:

1. A multifunctional exercise machine comprises: a stepper assembly; a stationary bicycle assembly comprising a flywheel assembly, a first cycle pedal, and a second cycle pedal; a stepper resetting mechanism comprising a pulley and a chain; a frame member; a stand member; a bridge; the stepper assembly comprises a first step pedal and a second step pedal; the first step pedal and the second step pedal being slidably mounted along the frame member; the first step pedal and the second step pedal being positioned opposite to each other about the frame member; the stepper resetting mechanism being operatively connected in between the stepper assembly and the frame member, wherein the stepper resetting mechanism returns the first step pedal and the second step pedal from an actuated position to an equilibrium position; the frame member being hingedly and adjacently connected to the bridge; the stand member being hingedly and adjacently connected to the bridge, opposite to the frame member; and the stationary bicycle assembly being mounted along the stand member; wherein a user can perform stepping exercises or perform bicycling exercises on the exercise machine.

2. The multifunctional exercise machine as claimed in claim 1 further comprises: the frame member comprises a first rail and a second rail; the first rail and the second rail being positioned adjacent to each other; the first step pedal being slidably engaged to the first rail; the second step pedal being slidably engaged to the second rail; a first end of the chain being tethered to the first step pedal; a second end of the chain being tethered to the second step pedal; the pulley being rotatably mounted to the first rail and the second rail; the chain being tensionably engaged about the pulley; and the pulley being positioned adjacent to the bridge.

3. The multifunctional exercise machine as claimed in claim 2 further comprises:

a first detachable carriage;

a second detachable carriage;

the first step pedal being slidably mounted to the first rail by the first detachable carriage; and the second step pedal being slidably mounted to the second rail by the second detachable carriage.

4. The multifunctional exercise machine as claimed in claim 1 further comprises:

the frame member comprises a first rail and a second rail;

the first rail and the second rail each comprise a concave portion; and the concave portion being oriented toward the frame member.

5. The multifunctional exercise machine as claimed in claim 2 further comprises:

a chain braking system;

the chain braking system being mechanically integrated between the frame member and the stepper resetting mechanism; and the chain being operatively integrated through the chain braking system, wherein the chain braking system increases or decreases angular speed of the chain about the pulley.

6. The multifunctional exercise machine as claimed in claim 1 further comprises: the flywheel assembly being mounted along the stand member; the first cycle pedal and the second cycle pedal being torsionally connected into the flywheel assembly; and a rotation axis of the first cycle pedal and a rotation axis of the second cycle pedal being oriented perpendicular to the stand member.

7. The multifunctional exercise machine as claimed in claim 1 further comprises:

an adjustable seat; and the adjustable seat being mounted into the bridge.

8. The multifunctional exercise machine as claimed in claim 7 further comprises: a seat adjustment member; the seat adjustment member being adjacently connected to the adjustable seat; and the seat adjustment member being slidably engaged into the bridge.

9. The multifunctional exercise machine as claimed in claim 8 further comprises:

a seat adjustment member;

the seat adjustment member being adjacently connected to the adjustable seat; and the seat adjustment member being rotatably engaged into the bridge.

10. The multifunctional exercise machine as claimed in claim 1 further comprises:

at least one mounting bracket;

the at least one mounting bracket being positioned on the stand member; and the stationary bicycle assembly being removably mounted to the stand member by the at least one mounting bracket.

11. The multifunctional exercise machine as claimed in claim 1 further comprises:

a handlebar assembly; and the handlebar assembly being mounted into the bridge.

* * * * *